US010137041B2

(12) United States Patent
Chen

(10) Patent No.: US 10,137,041 B2
(45) Date of Patent: Nov. 27, 2018

(54) HANDY TYPE ELECTRIC CARRIAGE

(71) Applicant: KUIANDA Company Limited, Kaohsiung (TW)

(72) Inventor: Mao-Chiang Chen, Kaohsiung (TW)

(73) Assignee: KUIANDA COMPANY LIMITED, Kaohsiung (TW)

( * ) Notice: Subject to any disclaimer, the term of this patent is extended or adjusted under 35 U.S.C. 154(b) by 83 days.

(21) Appl. No.: 15/387,966

(22) Filed: Dec. 22, 2016

(65) Prior Publication Data

US 2018/0078431 A1 Mar. 22, 2018

(30) Foreign Application Priority Data

Sep. 21, 2016 (TW) ..... 105214477 U

(51) Int. Cl.

| | |
|---|---|
| ***A61G 5/04*** | (2013.01) |
| ***A61G 5/08*** | (2006.01) |
| ***A61G 5/10*** | (2006.01) |
| ***A61G 5/12*** | (2006.01) |
| ***A61G 3/02*** | (2006.01) |

(52) U.S. Cl.

CPC ..... *A61G 5/045* (2013.01); *A61G 3/02* (2013.01); *A61G 5/043* (2013.01); *A61G 5/085* (2016.11); *A61G 5/1086* (2016.11); *A61G 5/1089* (2016.11); *A61G 5/128* (2016.11); *A61G 5/125* (2016.11); *A61G 2203/14* (2013.01)

(58) Field of Classification Search

CPC ..... A61G 5/045; A61G 5/1086; A61G 3/02
USPC ..... 180/22
See application file for complete search history.

(56) References Cited

U.S. PATENT DOCUMENTS 4,457,528 A * 7/1984 Ichikawa ..... A61G 5/00 280/250.1
7,384,046 B2 * 6/2008 Le Masne De Chermont ..... A61G 5/045 180/65.51
7,926,606 B2 * 4/2011 Wang ..... B62K 15/008 180/208
2017/0056259 A1 * 3/2017 Olsson ..... A61G 5/042

FOREIGN PATENT DOCUMENTS

JP 11309178 A * 11/1999 ..... A61G 5/02
JP 3181089 U * 1/2013 ..... A61G 5/02

* cited by examiner

*Primary Examiner* — Faye M Fleming
(74) *Attorney, Agent, or Firm* — Muncy, Geissler, Olds & Lowe, PC

(57) ABSTRACT

A handy type electric carriage comprises a vehicle body comprising a main vehicle frame, two driving wheels pivoted to the main vehicle frame at two sides, and two front wheel sets provided at two sides in front of the two driving wheels and pivoted to the main vehicle frame; and a footrest unit connected to the vehicle body, the footrest unit comprising a foot board connected to the main vehicle frame, and two first auxiliary wheels at left and right sides of the foot board. The main vehicle frame is situated in an unfolded or folded state due to a positioning mechanism. The front wheel sets and the main vehicle frame are pivoted in a manner of quick-release structure. Thereby, reduction in volume and easier to carry are provided for the handy type electric carriage, and providing easy and labor-saving shifting of the carriage is achieved.

9 Claims, 6 Drawing Sheets

HANDY TYPE ELECTRIC CARRIAGE

FIELD OF THE INVENTION

The present invention is related to a handy type electric carriage, particularly to a handy type electric carriage to be carried and stored easily.

BACKGROUND OF THE INVENTION

In modern times, generally, when the situations, such as paraplegia and etc., possibly caused by serious diseases or injuries due to traffic accident, stroke, and etc., incapability of standing and walking easily caused by muscle atrophy of two feet due to prolonged bed rest without walking on two feet, and bradykinesia or incapability of walking easily on two feet caused by degradation of physiological function with advancing age, it is commonly to use auxiliary tools, such as crutches, wheelchairs and the like for aiding the movement if long-distance travel is desired. Manual force, however, is required to move such kind of auxiliary tools, in such a way that not only vitality is consumed, but also faster movement could not be achieved. Thus, a lot of trouble and inconvenience are presented in life.

Therefore, various electric wheelchair means, such as electric scooters, electric wheelchairs and so on, all of which enable the physically challenged users to move and act conveniently by converting electric energy into kinetic energy as power, are launched by the industry. In the current market, several electric wheelchair means are allowed to provide the effect of convenient movement and action through conversion of electrical energy into kinetic energy, but the above electrical wheelchair means are commonly designed as integral structure and then incapable of being folded for storage in the practical use. In this connection, the space occupied by, and space for storing electrical wheelchair not in use is quite large, so as to cause extreme inconvenience and trouble no matter in placement, shifting, transportation, storage or movement. Although the occupied space may be reduced due to detachable approach utilized by the industry, not only more time is consumed in assembling and disassembling, but also utmost troublesome inconvenience in operation is obvious in such an assembling and disassembling process. Further, damage to other objects may be possible when the electric wheelchair is shifted by dragging directly. In addition, larger force is required to place the electric wheelchair into the trunk, and thus, more vitality is consumed. Thereby, there is still much room for improvement for the above problems.

Accordingly, in light of the above, a handy type electric carriage is provided by the applicant on the basis of extensive experience in designing, developing and manufacturing in the related industry, as well as further research and improvement on the current structure and drawbacks, for achieving the object of better practical utility desirably.

SUMMARY OF THE INVENTION

It is the object of the present invention to solve the above problems, and thus provide a handy type electric carriage to be carried conveniently and stored easily. The handy type electric carriage is provided with a labor-saving structure for storage, which enables easier shifting by a user. The features of the present invention is:

1. providing easy and labor-saving shifting of the handy type electric carriage through two first auxiliary wheels in the present invention;

2. situating two supporting rods in an unfolded or a folded state due to a positioning mechanism, in such a way that reduction in volume and easier to carry are provided for the handy type electric carriage in the present invention;
3. allowing two feet of a user to be laid on a foot board between two position limiting parts, so as to avoid danger caused when the two feet are moved out of the foot board in the present invention; and
4. rapid detachment of two front wheel sets from a main vehicle frame for easier shifting of the handy type electric carriage because of reduction in weight due to the detachment in the present invention.

DETAILED DESCRIPTION OF THE PREFERRED EMBODIMENTS

Figure 1:
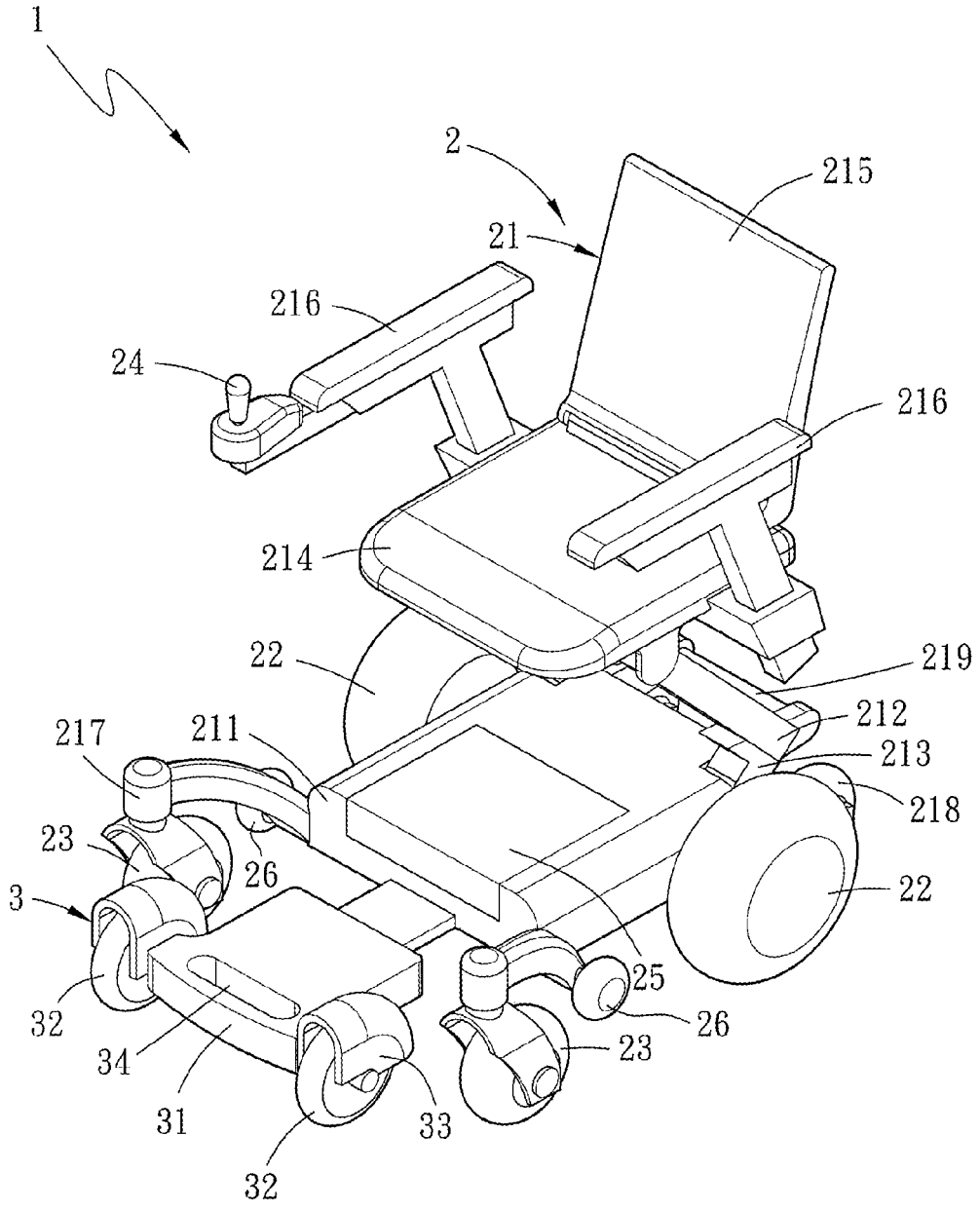
FIG. 1 is a perspective view of the present invention.

Referring to FIGS. 1 to 4, the present invention provides a handy type electric carriage 1, comprising a vehicle body 2 and a footrest unit 3. In this case, the vehicle body 2 comprises a main vehicle frame 21 provided as a main supporting structure for the handy type electric carriage 1, two driving wheels 22 individually pivoted to the main vehicle frame 21 at two sides thereof and mainly provided for the handy type electric carriage 1 to output power for movement, and two front wheel sets 23 individually and correspondingly provided at two sides in front of the two driving wheels 22 as well as individually pivoted to the main vehicle frame 21 for facilitating the movement of the handy type electric carriage 1.

Subsequently, the main vehicle frame 21 in this case comprises a base 211, two supporting rods 212 individually pivoted to two ends of the base 211 and configured to form unfolded and folded states via a positioning mechanism 213, a seat 214 pivoted to the two supporting rods 212 while at one end far away from the base 211, a backrest 215 pivoted to the seat 214 at one end thereof while provided as the backrest for the user, and two hand rests 216 individually connected to the seat 214 at two side thereof while provided for the user to place two hands. Further, the two hand rests 216 are adjustable in height for providing the user with more comfortable surrounding for riding. The seat 214 is allowed to be closer to the base 211 through the two supporting rods 212 and through the positioning mechanism 213, and the backrest 215 may be folded to be close to the seat 214, as well as the location of the two hand rests 216 may be adjusted to the lowest height, such that the main vehicle frame 21 is reduced in volume to create the advantage of easier to store without taking up much space.

Subsequently, the two front wheel sets 23 and the main vehicle frame 21 are pivoted in a manner of quick-release structure. Further, between each of the two front wheel sets 23 and the main vehicle frame 21, there is provided with an extension rod 217. Each extension rod 217 is connected to the base 211 at each of two sides thereof, respectively, while each extension rod 217 is pivoted to a second auxiliary wheel 26. The two second auxiliary wheels 26 are provided for facilitating the movement of the handy type electric carriage 1. At two rear ends of the main vehicle frame 21, further, two rear auxiliary wheels 218 are pivoted, respectively. The effect of the two second auxiliary wheels 26 are equally obtained by the two rear auxiliary wheels 218. Furthermore, at the rear end of the base 211, a pull rod 219 is provided to be used when pulling the handy type electric carriage 1 is required.

Next, the footrest unit 3 connected to the vehicle body 2 is additionally provided. The footrest unit 3 comprises a foot board 31 connected to the main vehicle frame 21, and two first auxiliary wheels 32 individually provided at left and right sides of the foot board 31 while provided for the handy type electric carriage 1 to be moved in a time- and labor-saving manner with easier movement and without liability to scrape against other objects. In this case, the foot board 31 is individually provided at two ends thereof with two position limiting parts 33 for restricting two feet of the user to a location between the two position limiting parts 33, so as to avoid danger caused when the two feet are moved out of the range of the foot board 31 in travel, and a hand hole 34 is provided on the foot board 31 to be used when the front end of the handy type electric carriage 1 is lifted by the user.

Subsequently, the main vehicle frame 21 is provided with a controller 24 for controlling the travel of the handy type electric carriage 1. The controller 24 is provided on one of the hand rests 216, depending upon the strong hand of the user. On the main vehicle frame 21, there is provided with a power supply part 25 on the base 211. Moreover, the power supply part 25 is electrically connected to the controller 24, and electrically connected to a driving part (not shown in the figures) connected to the two driving wheels 22. The driving part is controlled by the controller 24 to drive and steer the two driving wheels 22, such that the handy type electric carriage 1 may be steered and moved.

Figure 2:
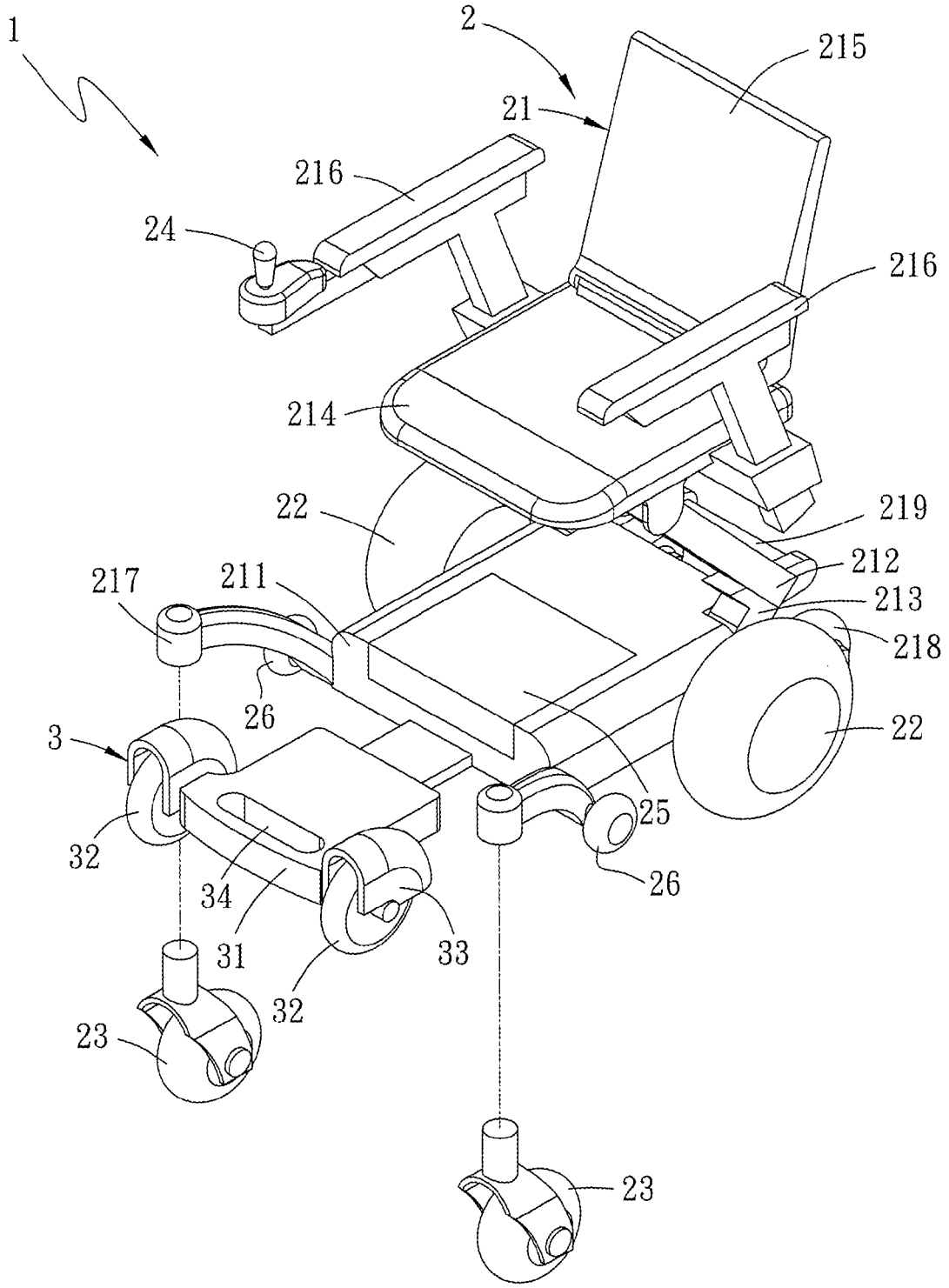
FIG. 2 is an exploded perspective view of the present invention.
Figure 3:
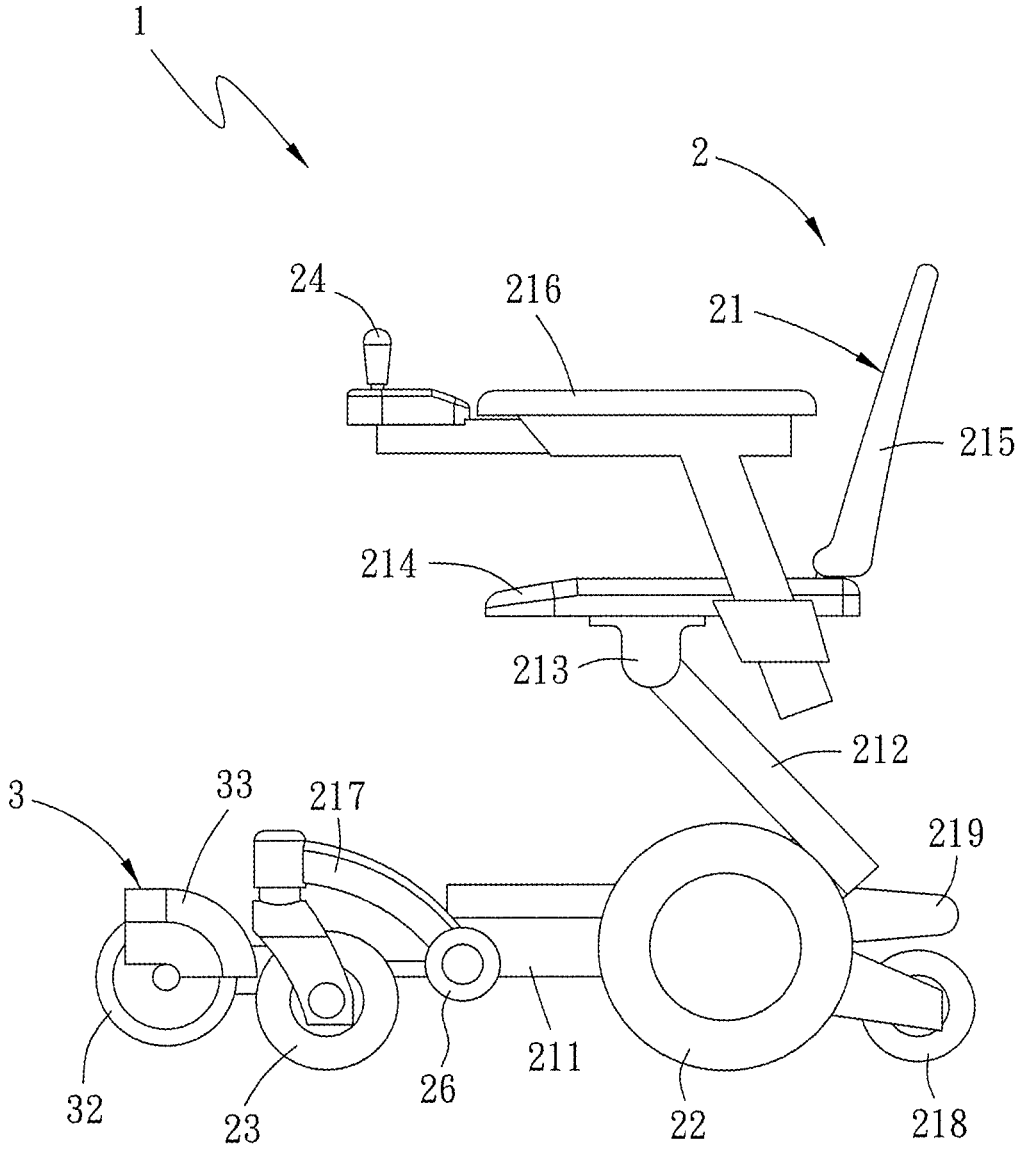
FIG. 3 is a side view of the present invention.
Figure 4:
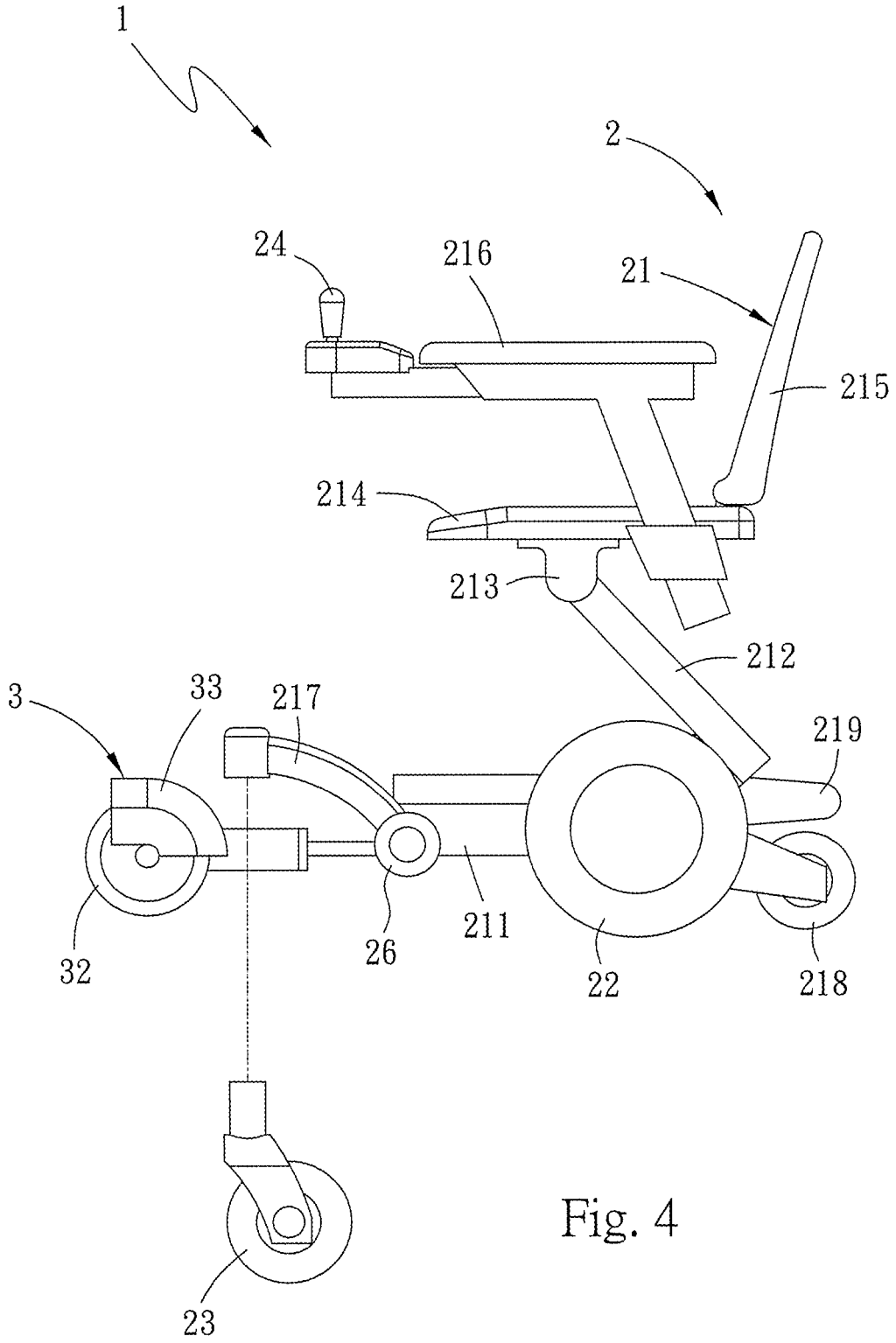
FIG. 4 is an exploded side view of the present invention.
Figure 5:
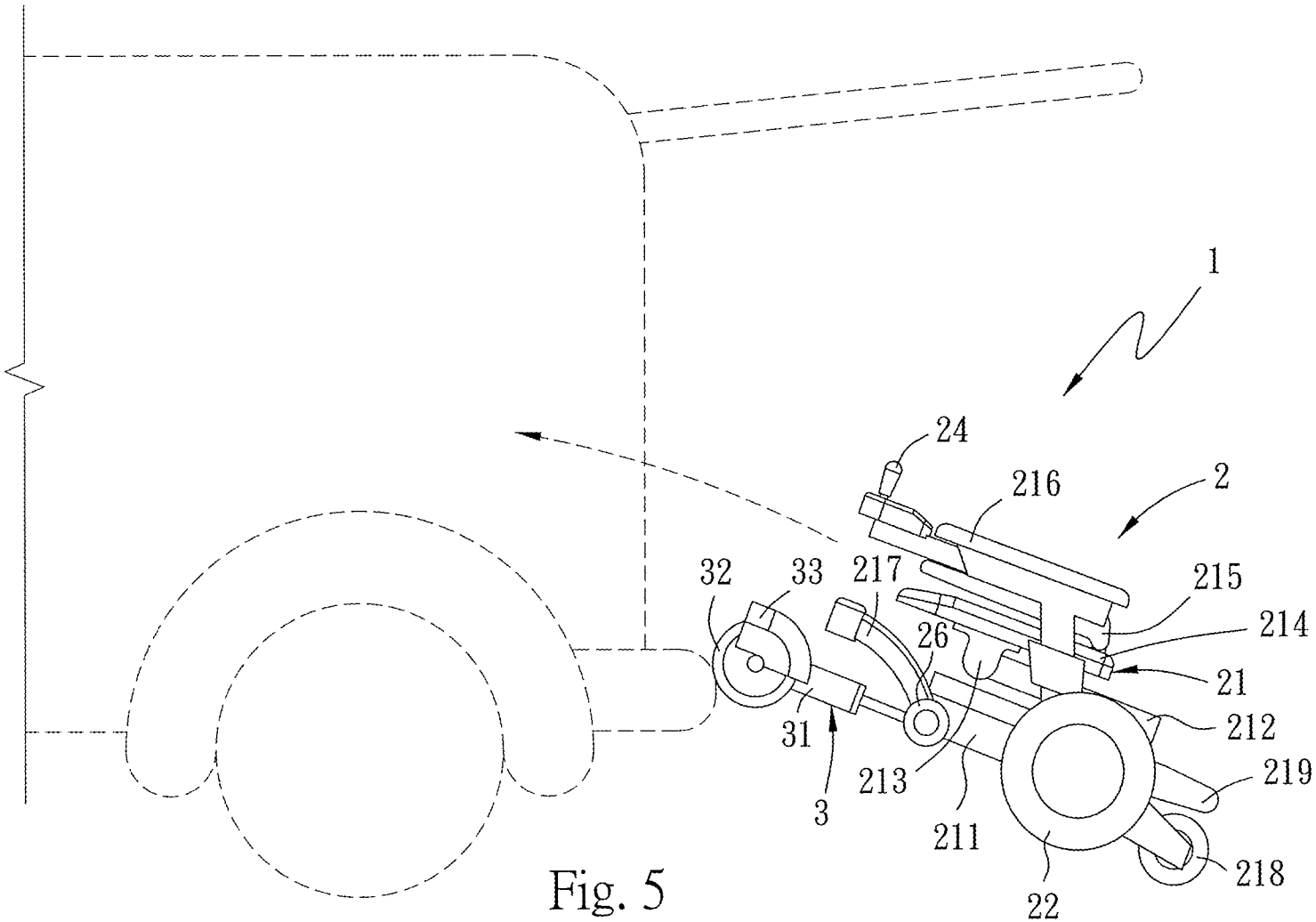
FIG. 5 is a diagram showing the loading into the automobile of the present invention.
Figure 6:
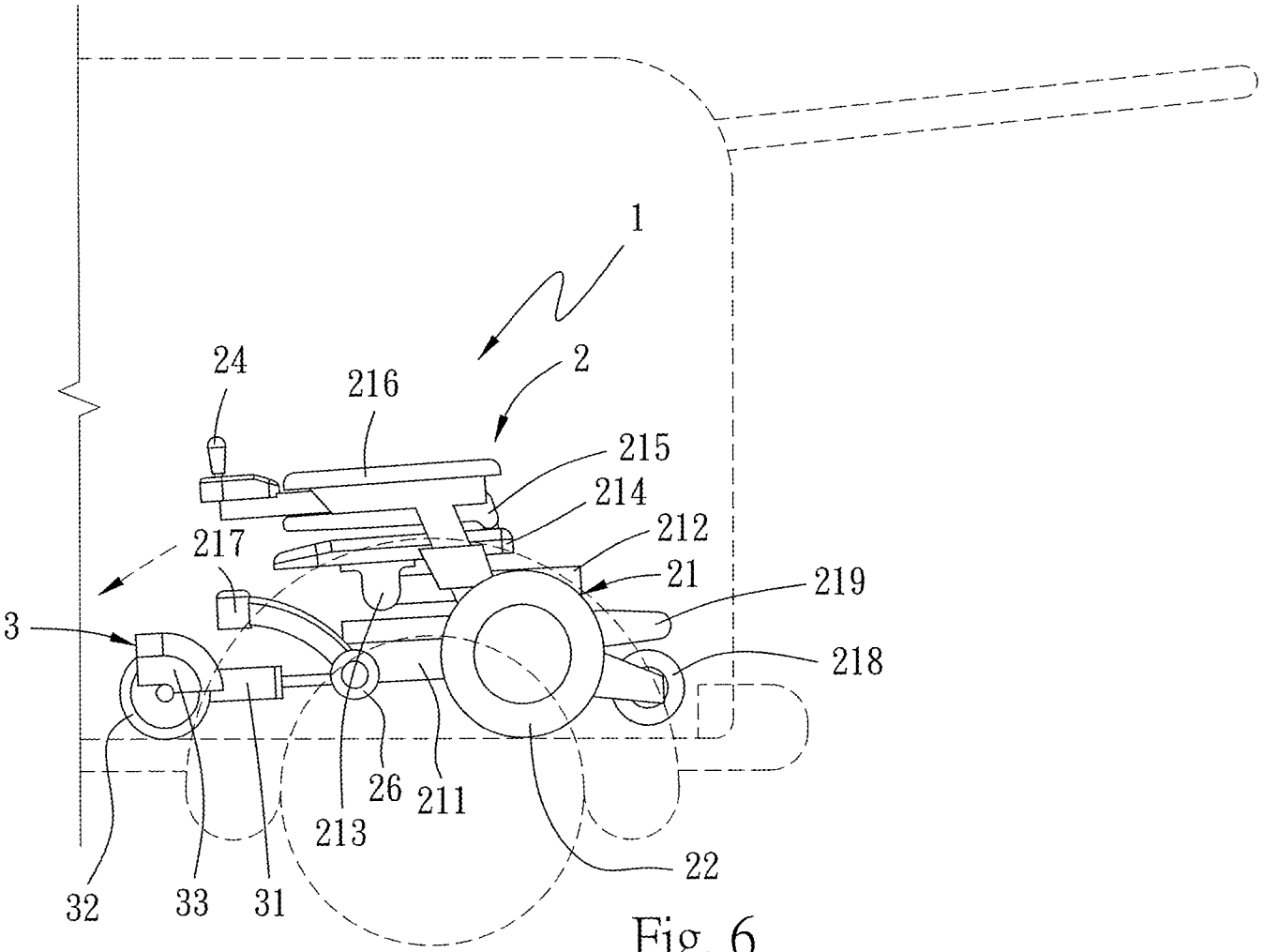
FIG. 6 is a diagram showing the placement in the automobile of the present invention.

In the practical use, referring to FIGS. 5 and 6 together with FIGS. 1 and 2, how to shift the handy type electric carriage 1 into a trunk of an automobile in one embodiment will be described. Firstly, each of the front wheel sets 23 is detached from the individual extension rod 217, to which it is pivoted, through the quick-release structure. Then, the front of the handy type electric carriage 1 is tilted via the center of gravity, and the front end of the handy type electric carriage 1 is lifted by use of the hand hole 34. Moreover, the two first auxiliary wheels 32 on the foot board 31 are used to abut against the trunk of the automobile, while the pull rod 219 is grasped by hands to raise and push forward the handy type electric carriage 1. Furthermore, the first auxiliary wheels 32 and the second auxiliary wheels 26 are contacted with different uneven surfaces, and thus rotated, such that the handy type electric carriage 1 may be slid into the trunk easily, followed by putting the two front wheel sets 23 detached previously into the trunk. Thus, easy and labor-saving movement is achieved, while the effect of reduction in volume is achieved by folding the main vehicle frame 21 totally.

Next, when dragging the handy type electric carriage 1 out of the trunk is required, it is only necessary to raise the handy type electric carriage 1 by use of the pull rod 219, such that the two first auxiliary wheels 32 at left and right sides of the foot board 31 in cooperation with the two rear auxiliary wheels 218 individually pivoted to two rear ends of the main vehicle frame 21 are dragged outwardly along the inner edge of the trunk, and the two first auxiliary wheels 32 are dragged outwardly along the trunk floor. The two first auxiliary wheels 32 and the two second auxiliary wheels 26 are capable of facilitating the drag. Afterward, the two front wheel sets 23 put into the trunk previously are combined with the two extension rods 217, respectively, via the quick-release structure rapidly, so as to complete the assembly of the handy type electric carriage 1.

As described above, the present invention, in comparison with the prior art, provides easy and labor-saving shifting of the handy type electric carriage 1 through the two first auxiliary wheels 32. Further, the two supporting rods 212 may be situated in an unfolded or a folded state due to the positioning mechanism 213, in such a way that reduction in volume, easier to carry, easier storage in the automobile, easier shifting, and little occupied space are provided for the handy type electric carriage 1. Rapid detachment and installation of the two front wheel sets 23 from and to the main vehicle frame 21 is beneficial for easier shifting because of reduction in weight due to the detachment. Further, intuitive installation and detachment of the two front wheel sets 23 with ease is enabled by the quick-release structure, so as to achieve the effects of rapid storage and movement, as well as saving time and labor.

What is claimed is:

1. A handy type electric carriage, comprising:

a vehicle body, comprising a main vehicle frame, two driving wheels individually pivoted to said main vehicle frame at two sides thereof, and two front wheel sets individually and correspondingly provided at two sides in front of said two driving wheels as well as pivoted to said main vehicle frame, wherein said two front wheel sets and said main vehicle frame are pivoted in a manner of quick-release structure; and a footrest unit connected to said vehicle body, said footrest unit comprising a foot board connected to said main vehicle frame, and two first auxiliary wheels individually provided at left and right sides of said foot board.

2. The handy type electric carriage according to claim 1, wherein said foot board is individually provided at two ends thereof with two position limiting parts.

3. The handy type electric carriage according to claim 1, wherein said main vehicle frame comprises a base, two supporting rods individually pivoted to two ends of said base, a seat pivoted to said two supporting rods while at one end far away from said base, a backrest pivoted to said seat at one end thereof, and two hand rests individually connected to said seat at two side thereof.

4. The handy type electric carriage according to claim 3, wherein said base is provided at the rear end thereof with a pull rod.

5. The handy type electric carriage according to claim 3, wherein said two supporting rods are situated in an unfolded or a folded state through a positioning mechanism.

6. The handy type electric carriage according to claim 1, wherein said main vehicle frame is provided with a controller for controlling the travel of said handy type electric carriage; and said main vehicle frame is provided with a driving part connected to said two driving wheels.

7. The handy type electric carriage according to claim 1, wherein said foot board is provided with a hand hole.

8. The handy type electric carriage according to claim 1, wherein said two first auxiliary wheels at left and right sides of said foot board are cooperated with two rear auxiliary wheels individually pivoted to two rear ends of said main vehicle frame.

9. The handy type electric carriage according to claim 1, wherein between said main vehicle frame and each of said front wheel sets, there is further provided with an extension rod, each of said extension rods being pivoted to a second auxiliary wheel.

* * * * *